United States Patent [19]

Morris

[11] Patent Number: 4,590,785

[45] Date of Patent: May 27, 1986

[54] METHOD AND APPARATUS FOR FLARING A TUBE

[75] Inventor: John P. Morris, Lockport, Ill.

[73] Assignee: Andrew Corporation, Orland Park, Ill.

[21] Appl. No.: 585,827

[22] Filed: Mar. 2, 1984

[51] Int. Cl.[4] ..... B21D 41/02

[52] U.S. Cl. ..... 72/392; 72/370; 72/454; 29/600

[58] Field of Search ..... 72/316, 323, 392, 395, 72/370, 407, 454; 413/73, 76, 75; 29/600

[56] References Cited

U.S. PATENT DOCUMENTS

| | | | |
|---|---|---|---|
| 62,852 | 3/1867 | Jennings | 72/392 |
| 1,430,743 | 10/1922 | Kruse | 413/73 |
| 1,703,992 | 3/1929 | Dawley | 72/392 |
| 1,823,047 | 9/1931 | Hothersall | 72/370 |
| 1,854,170 | 4/1932 | Hermani | 72/323 |
| 3,411,338 | 11/1968 | Carlin | 72/316 |
| 4,069,700 | 1/1978 | Bocharov et al. | 72/454 |

OTHER PUBLICATIONS

Andrew Corporation Catalog No. 32, 1983, p. 68.

*Primary Examiner*—Daniel C. Crane
*Attorney, Agent, or Firm*—Leydig, Voit & Mayer, Ltd.

[57] ABSTRACT

A flare is formed on the end of a tubular waveguide of elliptical cross-section by first expanding a pair of flaring lugs along the major axis of the ellipse and then by expanding a second pair of flaring lugs along the minor axis of the ellipse.

10 Claims, 12 Drawing Figures

METHOD AND APPARATUS FOR FLARING A TUBE

BACKGROUND OF THE INVENTION

This invention relates to the formation of an external flare around the end of a metal tube. While the tube on which the flare is formed may be of various cross-sectional shapes, the invention is particularly concerned with flaring a tube of substantially elliptical cross-section. Such tubes are widely used as waveguides in microwave antenna feeder systems. When the elliptical tube is used as a waveguide, the end flare may, for example, abut a waveguide connector in order to establish electrical contact between the waveguide and the connector.

To establish good electrical contact between the waveguide and the connector, it is important that the metal end flare be soft and ductile, be free of cracks and be of substantially uniform thickness. Previously available flaring tools for forming elliptical flares have not been able to completely satisfy these criteria. The most widely used flaring tool repeatedly hits or works the metal at the end of the waveguide as the flare is being formed. As a result of such repeated working, the metal is work-hardened and becomes so brittle that the flare often cracks either during the flaring operation itself or when the waveguide connector is coupled to the waveguide. The previously available tool also thins the metal of the flare and forms a flare which may be thinner on the minor axis of the waveguide than on the major axis thereof. The non-uniformity in thickness, together with the hardness of the flare, makes it difficult to locate the flare in tight and full face-to-face contact with the waveguide connector and thus makes it difficult to establish a good electrical joint between the waveguide and the connector.

SUMMARY OF THE INVENTION

The general aim of the present invention is to flare a tube, and preferably an elliptical tube, in such a manner that the flare is soft and ductile and is of virtually uniform thickness around the entire periphery of the tube.

A related object of the invention is to provide a new and easy-to-use flaring tool adapted to flare an elliptical tube by working any given portion of the metal only once so as to avoid making the metal brittle and susceptible to cracking.

Still another object of the invention is to provide a flaring tool which gently scuffs the metal at the end of the tube outwardly into a flare while avoiding thinning of the metal during the flaring operation.

A more detailed object is to provide a flaring tool having a pair of flaring lugs adapted to telescope into the end of the tube and adapted to form the flare upon being spread away from one another along one of the transverse axes of the tube.

The invention also resides in the novel method of flaring an elliptical tube by first spreading one set of flaring lugs away from one another along the major axis of the ellipse and then by spreading another set of flaring lugs away from one another along the minor axis of the ellipse.

These and other objects and advantages of the invention will become more apparent from the following detailed description when taken in conjunction with the accompanying drawings.

BRIEF DESCRIPTION OF THE DRAWINGS

FIG . 1 is an exploded perspective view showing a typical elliptical waveguide with a flared end and showing a typical waveguide connector adapted to be coupled to the waveguide.

DETAILED DESCRIPTION

For purposes of illustration, the invention is shown in conjunction with a waveguide 14 of the type used to carry a signal in a microwave antenna feeder system. The waveguide comprises a corrugated tube 15 made of copper or other conductive metal, the tube herein having an elliptical cross-section. The end of the tube is formed with an outwardly extending flare 16 which also is elliptical in shape. A sheath 17 of insulating material encapsulates the major length of the tube.

Figure 1:
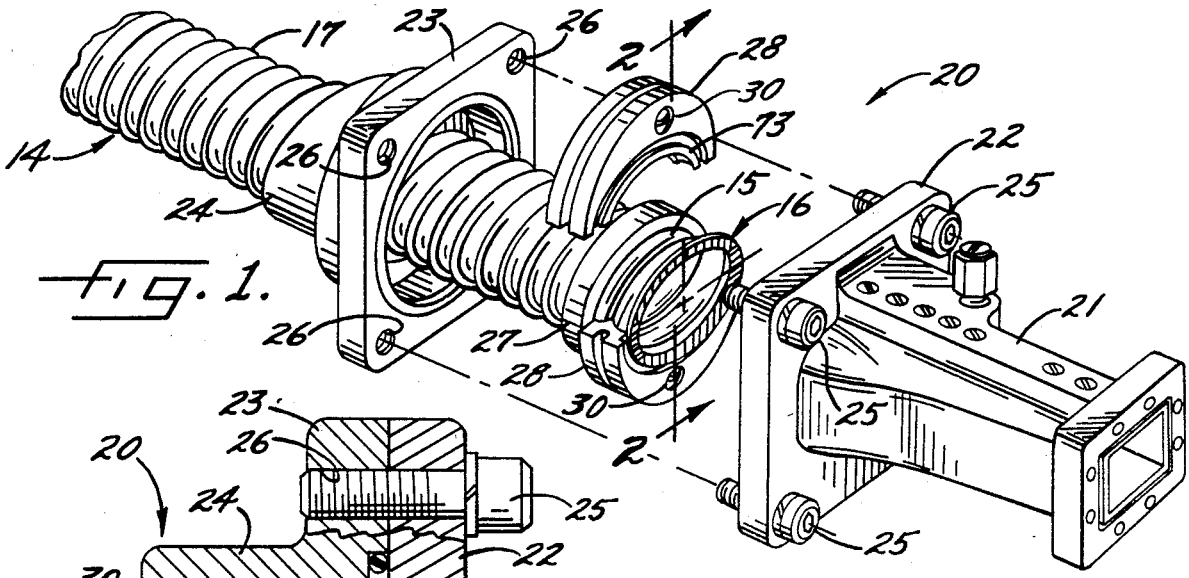
Figure 2:
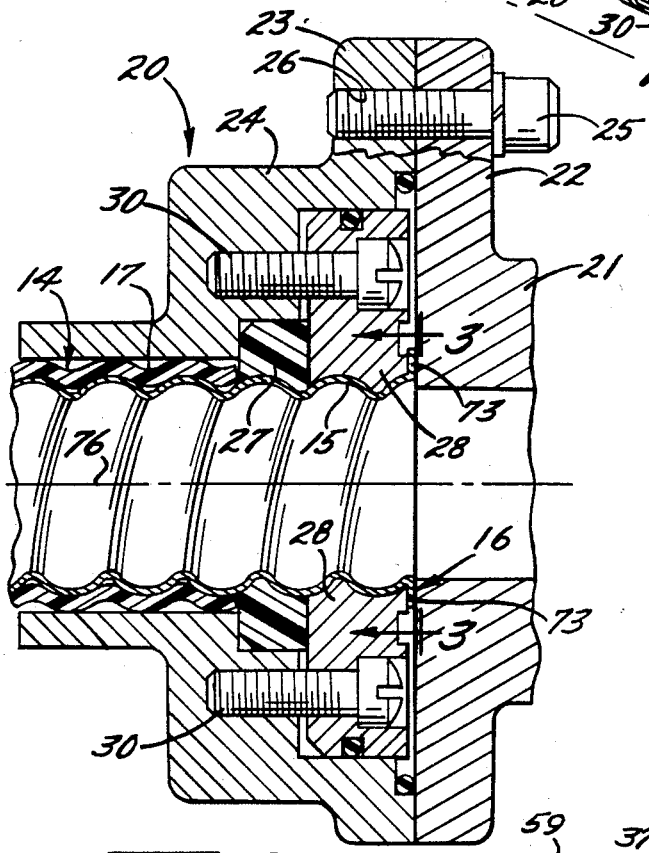
FIG. 2 is an enlarged fragmentary cross-section taken substantially along the line 2—2 of FIG. 1.

A waveguide connector 20 is coupled to the end portion of the tube 15 to effect an elliptical-to-rectangular transition and enable the waveguide 14 to be connected to an antenna feed horn or the like. In this instance, the waveguide connector 20 comprises a transition body 21 of rectangular cross-section and formed with a mounting flange 22 adapted to be fastened to the flange 23 of a so-called compression ring 24, the two flanges being connected by four screws 25 threaded into holes 26 in the flange 23. The compression ring 24 is telescoped over the end portion of the waveguide 14 and is sealed to the tube 15 by an annular gasket 27 (FIG. 2). A split flare ring formed by two separate half-moon shaped pieces 28 is telescoped over the tube 15 and into the compression ring 24 and is sandwiched tightly between the flare 16 and the gasket 27. Two screws 30 fasten the pieces 28 of the split flare ring tightly to the compression ring 24. The inside surfaces of the split flare ring pieces 28 are grooved so as to be complementary with the external corrugations of the tube 15 and thus the compression ring and the split flare ring pieces are held against moving axially along the tube once the screws 30 are tightened. When the screws 25 are tightened, the transition body 21 and the split ring pieces 28 are clamped in tight electrical contact with opposite sides of the end flare 16 as shown in FIG. 2.

In accordance with the present invention, the flare 16 on the end of the elliptical tube 15 is formed by first expanding the metal of the tube outwardly along the major axis X—X of the ellipse and then by expanding the metal outwardly along the minor axis Y—Y of the ellipse. The two-step operation of the present invention "works" any given portion of the metal only once so that the metal does not become work-hardened and brittle and thus is not susceptible to cracking. In addition, the flare 16 is formed with a substantially uniform thickness to enable the flare to establish good electrical contact with the transition body 21 and the split ring pieces 28 around the entire periphery of the flare.

Figure 3:
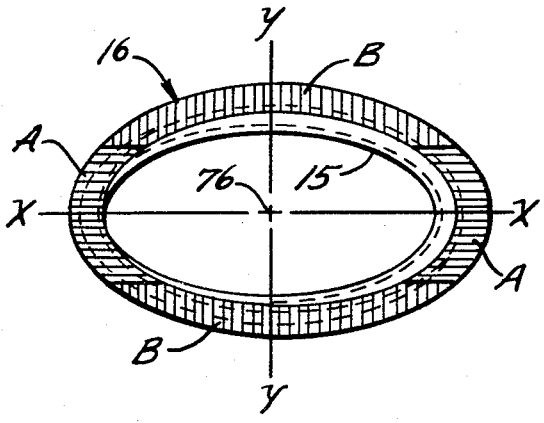
FIG. 3 is a view taken substantially along the line 3—3 of FIG. 2 and showing the flare at the end of the tube.

Pursuant to the invention, the flaring operation is carried out with two unique tools 35 and 35', the tool 35 being used to form the flare 16 at two spaced zones A (FIG. 3) adjacent the ends of the major axis X—X of the elliptical tube 15 and the tool 35' being used to form the flare at two spaced zones B adjacent the ends of the minor axis Y—Y of the tube. Except for two differences which will be explained subsequently, the two tools are substantially the same. Accordingly, only the basic construction of the tool 35 will be described in detail since the basic construction of the tool 35' will be apparent from that description and from the corresponding but primed reference numerals used in the drawings in connection with the tool 35'.

Figure 4:
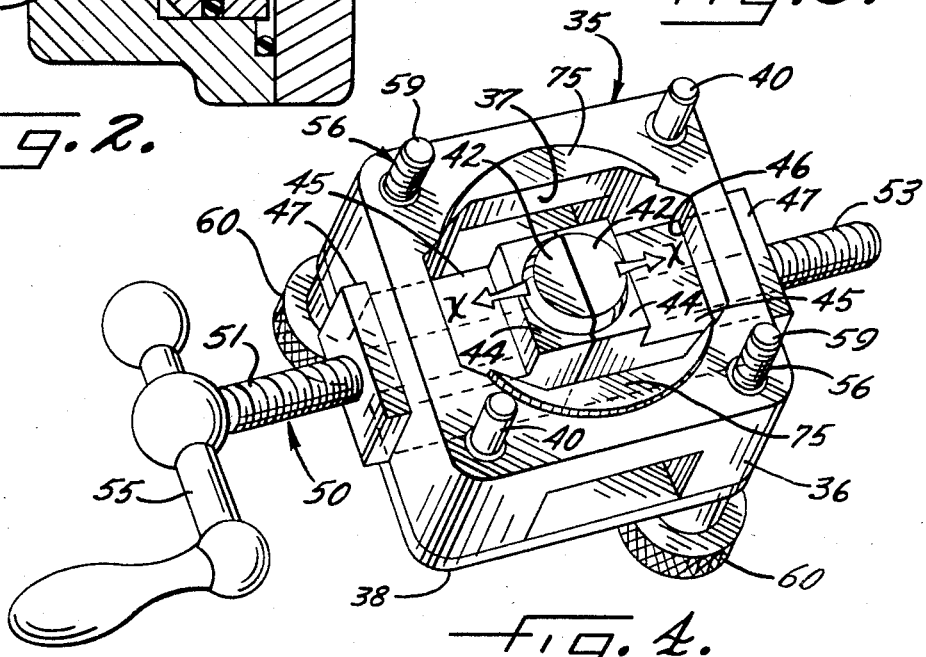
FIG. 4 is a perspective view of a tool for flaring the waveguide along the major axis of the ellipse.
Figure 11:
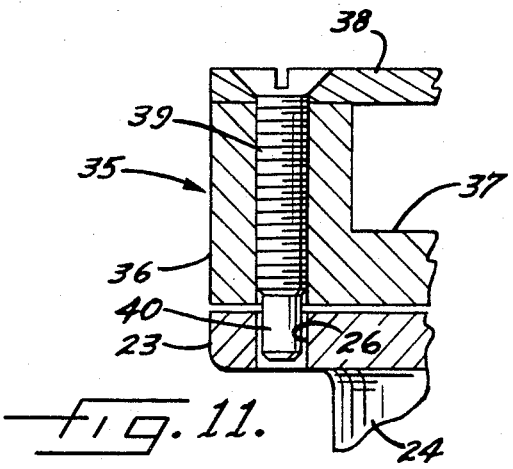
FIGS. 11 and 12 are fragmentary cross-sections taken substantially along the lines 11—11 and 12—12, respectively, of FIG. 7.

As shown in FIG. 4, the tool 35 comprises a generally rectangular block-like body 36 made of steel. A central cavity or pocket 37 is formed in the body and opens out of the rear face thereof. The front side of the pocket is closed by a rectangular plate 38 which is secured to the body 36 by a pair of screws 39 (FIG. 11) threaded into the body and formed with pin-like ends 40 which project rearwardly from the body. The screws 39 are spaced from one another along one diagonal of the body 36.

In carrying out the invention, two flaring lugs 42 (FIG. 4) are disposed within the pocket 37 of the body 36 and are adapted to be spread from collapsed positions to expanded positions along the major axis X—X of the ellipse in order to flare the tube 15 along the two zones A at opposite end portions of the major axis. In the major axis flaring tool 35 shown in FIGS. 4, 7 and 8, the flaring lugs 42 are in the form of half-moon shaped buttons which coact with one another to define a circle when the lugs are in their fully collapsed positions. The periphery of each lug tapers gradually as the lug progresses rearwardly and thus each lug is of a generally frustoconical shape.

Each flaring lug 42 is formed on the rear face of a raised rib 44 (FIG. 4) which is integral with the inner end of an elongated mounting member or block 45 of rectangular cross-section. The outer end portion of each block is slidably guided within a rectangular slot 46 (see FIGS. 7 and 8) defined between the body 36 and th plate 38 and extending from the pocket 37 to the outer side of the body in the direction of the major axis X—X of the ellipse. A stop or flange 47 formed integrally with the outer side of each block is adapted to engage the outer side of the body to limit inward movement of the block. The two flanges 47 abut the outer sides of the body just before the lugs 42 would move into engagement with one another in the absence of the flange.

To enable the flaring lugs 42 to be moved between their collapsed and expanded positions, an elongated actuating screw 50 (FIG. 4) extends through the blocks 45 and the body 36. The screw is formed with a right hand thread 51 which is received in a correspondingly threaded bore 52 in one of the blocks and with a left hand thread 53 which is received in a similarly threaded bore 54 in the other block. Thus, the flaring lugs 42 are spread apart and moved toward their expanded positions when the screw is turned clockwise and are drawn together toward their collapsed positions when the screw is turned counterclockwise. To facilitate turning of the screw 50, a hand crank 55 (FIG. 4) is attached to one end of the screw.

Figure 12:
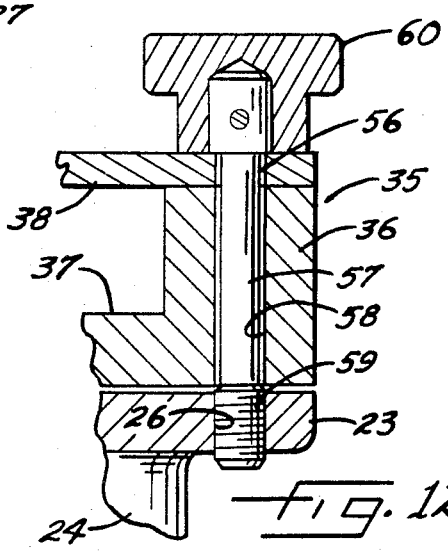

The tool 35 is completed by a pair of attaching screws 56 (FIGS. 4 and 12) spaced from one another along the other diagonal of the body 36. Each attaching screw includes an unthreaded shank portion 57 which extends loosely through holes 58 in the body 36 and the plate 38 and further includes a threaded end portion 59 which projects rearwardly from the body. A knurled knob 60 is attached to the forward end of each attaching screw 56 to facilitate turning of the screw.

Figure 5:
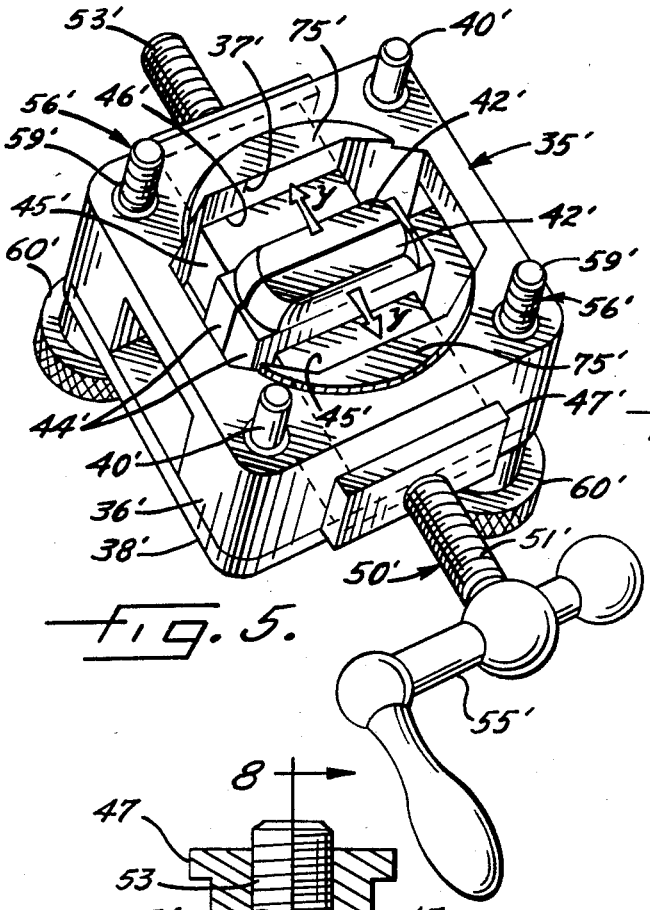
FIG. 5 is a perspective view of a tool for flaring the waveguide along the minor axis of the ellipse.
Figure 9:
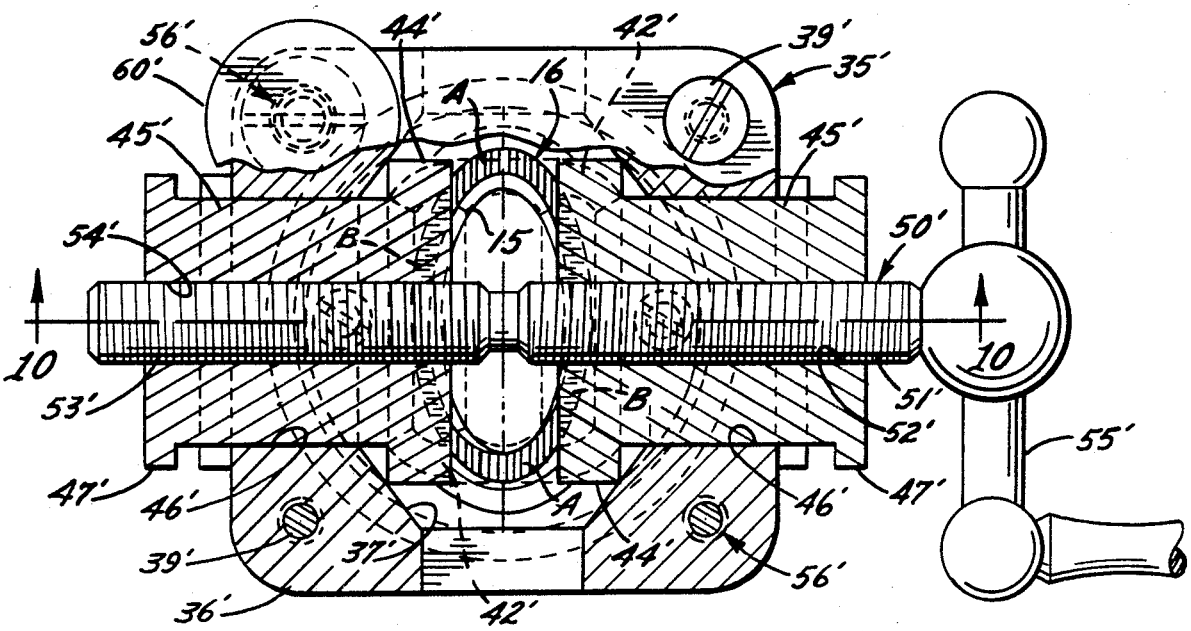
FIG. 9 is an enlarged bottom plan view of the minor axis flaring tool shown in FIG. 5, certain parts of the tool being broken away and shown in section as taken substantially along the line 9—9 of FIG. 10.
Figure 10:
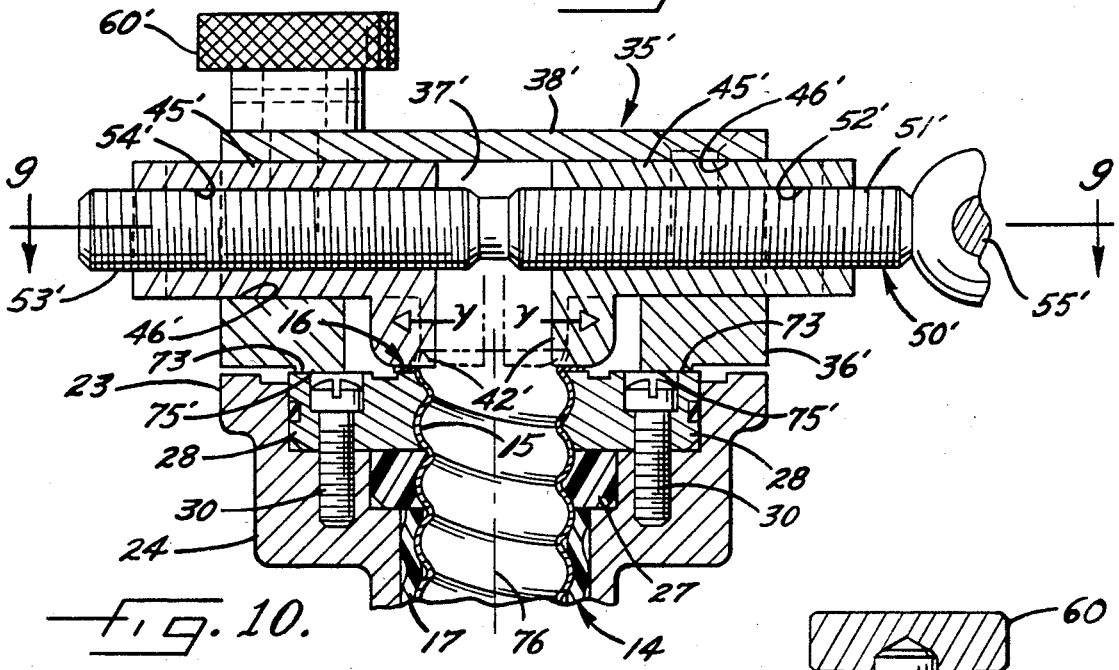
FIG. 10 is a fragmentary cross-section taken substantially along the line 10—10 of FIG. 9.

As shown in FIGS. 5, 9 and 10, the minor axis flaring tool 35' is identical to the major axis flaring tool 35 except for two basic differences. First, the blocks 45' and the screw 50' of the minor axis tool 35' are disposed at right angles to the blocks 45 and the screw 50 of the major axis tool 35 so that the blocks 45' move along the minor axis Y—Y of the ellipse rather than along the major axis X—X thereof. Secondly, the flaring lugs 42' are shaped as blocks which are elongated in the direction of the major axis X—X of the ellipse. The ends of each lug 42' are radiused and gradually taper upon progressing rearwardly from the rib 44'. Upon being spread to their expanded positions along minor axis Y—Y of the ellipse, the lugs 42' cause the tube 15 to flare along the two zones B (FIG. 3) located between the zones A.

Figure 6:
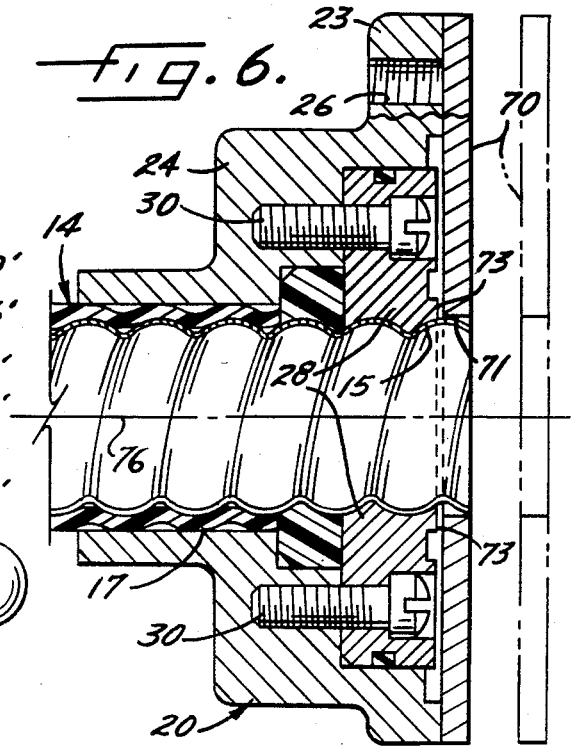
FIG. 6 is a cross-sectional view somewhat similar to FIG. 2 and shows a saw guide which is used to enable the waveguide to be cut to the proper length prior to the flare being formed on the waveguide.

The flaring operation is initiated by attaching the compression ring 24 and the split flare ring pieces 28 securely to the tube 15 with a length of the tube projecting forwardly beyond the split flare ring pieces. A plate-like saw guide 70 (FIG. 6) with a central hole 71 for receiving the tube then is abutted tightly against the forward side of the flange 23 of the compression ring 24 with the tube projecting a short distance through the hole 71. The forward face of the guide 70 thus forms a guide surface along which a saw may be traversed to cut off the tube 15 and to leave an accurately determined length of tube projecting forwardly beyond a forward locating face 73 on the forward side of each split flare ring piece 28. That forwardly projecting length of tube ultimately becomes the flare 16. And, as is apparent from FIG. 6, the locating faces 73 are spaced a short distance rearwardly from the forward face of the flange 23 of the compression ring 24.

After the tube 15 has been cut to an accurate length, the flaring tool 35 is used to form the zones A of the flare 16. For this purpose, the flaring tool 35 is attached to the flange 23 of the compression ring 24 by threading the screws 56 into two of the holes 26 of the flange 23, the pin-like ends 40 of the screws 39 piloting into the other two holes 26 to help initially aline the screws 56 with their holes (see FIGS. 11 and 12). As the screws 56 are tightened, the tool 35 is drawn toward the flange 23 until two raised and accurately machined locating pads 75 (FIG. 4) engage the locating faces 73 of the split flare ring pieces 28. The accurate locating pads 75 engage the accurate locating faces 73 before the less accurate rear side of the body 36 can move into engagement with the less accurate front side of the flange 23 and thus the rear faces of the lugs 42 are accurately located in an axial direction relative to the end of the tube 15.

Figure 7:
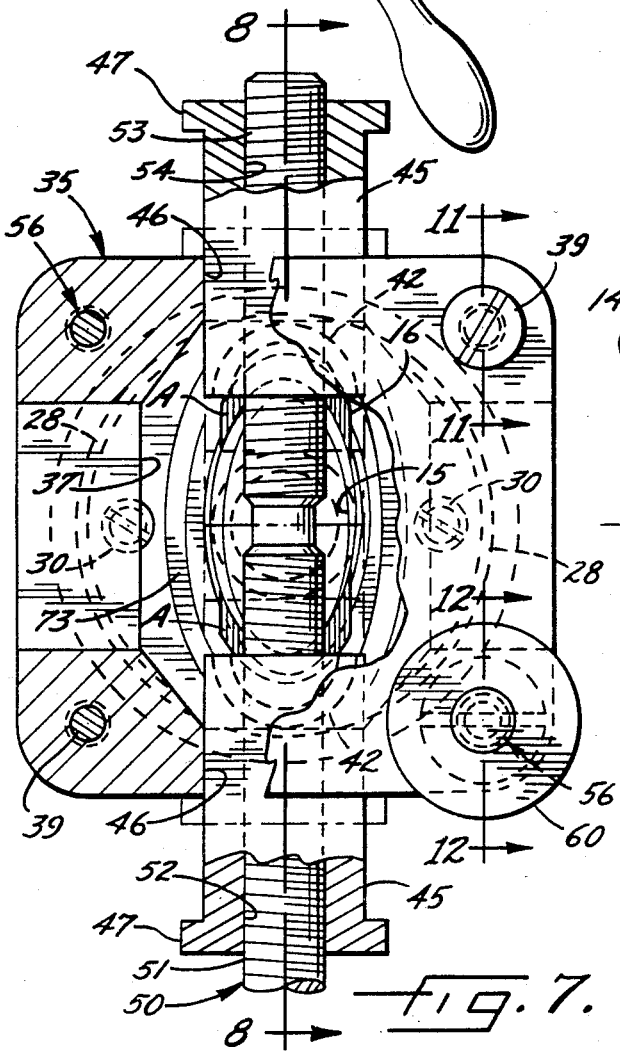
FIG. 7 is an enlarged bottom plan view of the major axis flaring tool shown in FIG. 4, certain parts of the tool being broken away and shown in section as taken substantially along the line 7—7 of FIG. 8.
Figure 8:
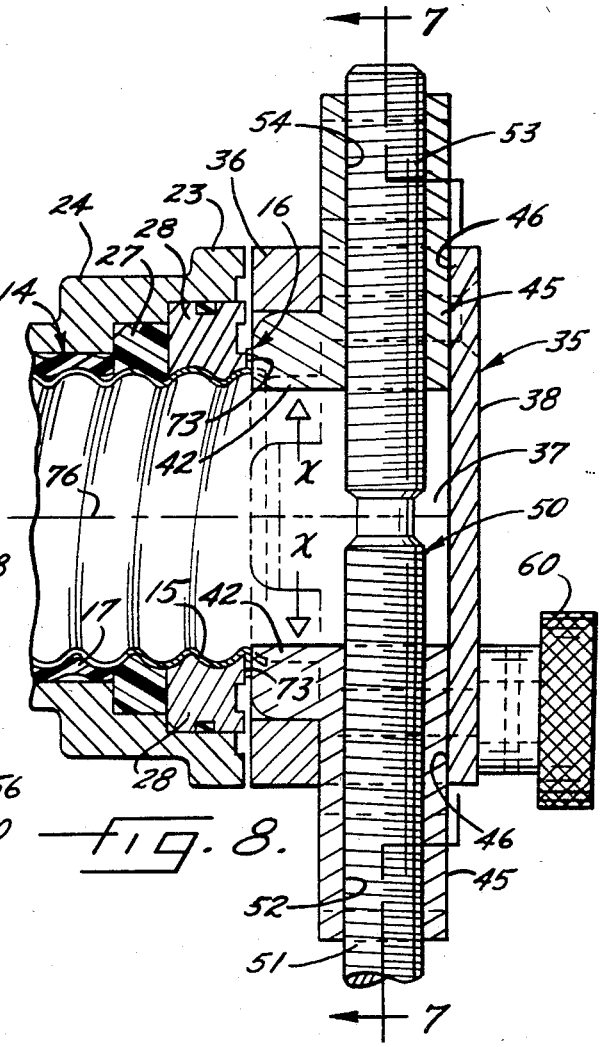
FIG. 8 is a fragmentary cross-section taken substantially along the line 8—8 of FIG. 7.

When the tool 35 is initially attached to the compression ring 24, the flaring lugs 42 are located in their collapsed positions as shown in FIG. 4 and shown in phantom lines in FIGS. 7 and 8 and thus the lugs telescope a short but accurately established distance into the end of the tube 15 when the attachment has been completed. Because of the slidable blocks 45 and the stop flanges 47, the lugs automatically assume centered positions within the pocket 37 and on the longitudinal axis 76 (FIG. 3) of the tube 15 when the lugs are in their collapsed positions and are telescoped into the tube. The straight sides of the lugs 42 extend along the minor axis Y—Y of the ellipse with the circle defined by the lugs being very nearly equal to the internal diameter of the tube along the minor axis.

When the screw 50 is turned clockwise, the blocks 45 slide outwardly within the slots 46 and cause the lugs 42 to spread apart from their collapsed positions toward their expanded positions. As the lugs expand, they scuff over the metal of the tube in the zones A and force such metal outwardly against the locating faces 73 of the split ring pieces 28 so as to form the flare 16 in the zones A. Importantly, the lugs engage the inside of the tube in the vicinity of the zones B and prevent the metal of the tube adjacent the latter zones from collapsing or being drawn inwardly as the zones A are flared. Also, the self-centering action of the lugs 42 causes the two lugs to spread equidistantly from the longitudinal axis 76 of the tube and to exert substantially equal pressure on the two zones A worked by the lugs. In this way, the lugs do not attempt to re-shape the geometry of the tube 15 but instead flare the two zones A substantially uniformly.

The lugs 42 are expanded outwardly until the outer sides of the ribs 44 engage the opposing sides of the pocket 37. Thereafter, the lugs are collapsed inwardly a short distance and then the tool 35 is detached from the compression ring 24.

The minor axis flaring tool 35' then is attached to the compression ring 24 by means of the screws 56' while the lugs 42' are in their collapsed positions. As the screws 56' are tightened, the lugs 42' are telescoped into the tube 15 except that the end portions of the lugs 42' lie flat against the previously flared zones A. As shown in FIG. 5, the straight opposing sides of the lugs 42' lie along the major axis X—X of the ellipse when the lugs are in their collapsed positions.

As the screw 50' is turned, the lugs 42' expand or spread away from one another along the minor axis Y—Y of the ellipse and, as an incident thereto, scuff over the metal in the zones B to force that metal outwardly against the locating surfaces 73 and complete the flare 16 around the entire periphery of the tube 15. During such movement, the end portions of the lugs 42' remain in flat face-to-face engagement with the flare in the previously flared zones A and prevent the metal of those zones from drawing inwardly as the zones B are flared outwardly. Again, the self-centering action of the lugs 42' enables the lugs to flare the zones B without distorting the elliptical geometry of the tube.

From the foregoing, it will be apparent that the present invention brings to the art a new and improved method for forming a flare 16 on the end of an elliptical tube without repeatedly working the metal and indeed while working any given portion of the metal only once. The flare which is formed is relatively soft and ductile and is of substantially uniform thickness so as to enable the flare to make good electrical contact with the waveguide connector 20.

While the invention has been disclosed in conjunction with two separate tools 35 and 35', it should be appreciated that those tools could be constructed as a unitary structure. In such a structure, the major axis lugs 42 would be on one side of a central body while the minor axis lugs 42' would be on the other side of that body. Also, the tools could be designed to form a flare on the end of a tube of rectangular or other non-circular cross-section.

I claim:

1. A tool for forming an external flare on the end of a corrugated elliptical waveguide having major and minor transverse axes, said tool comprising a body, means for detachably fastening said body to said waveguide, a pair of lugs sized and shaped to telescope at least partially into the end of said waveguide when said lugs are in collapsed positions, a pair of mounting members carrying said lugs within said body, means guiding said pair of mounting members for limiting sliding movement relative to said body along one of the transverse axes of said waveguide, drive means connected to both of said mounting members for moving said mounting members, and thus said lugs, toward and away from each other along said one axis within said body without restricting said sliding movement of said pair of mounting members, whereby said mounting members are free to slide, in unison, relative to said body along said one axis while said mounting members are being moved toward and away from each other along that axis, said drive means being attached to said mounting members for movement therewith along said one axis relative to said body, said lugs forming said flare as said lugs move toward said expanded positions.

2. A tool as defined in claim 1 in which said drive means comprises a rotatable screw having a left hand threaded portion threadably connected to one of said mounting members and having a right hand threaded portion threadably connected to the other of said mounting members.

3. A tool as defined in claim 1 further including stops on said mounting members and engageable with said body to limit movement of said mounting members toward and away from one another.

4. A tool as defined in claim 1 in which said body is formed with a pocket for receiving the end of said waveguide, said lugs being located in said pocket.

5. A tool as defined in claim 1 in which said body includes a locating surface engageable with said fastening means to limit the extent to which said lugs may be telescoped into said waveguide.

6. A tool as defined in claim 1 in which said lugs comprise generally half-moon shaped buttons having straight sides disposed in face-to-face relation and extending substantially along the minor axis of said waveguide when said lugs are in said collapsed positions, said drive means being connected to said lugs to move the lugs between said collapsed and expanded positions along the major axis of the waveguide.

7. A tool as defined in claim 1 in which said lugs comprise blocks elongated in the direction of the major axis of the waveguide and having sides disposed in face-to-face relation and extending substantially along the major axis of the waveguide when said lugs are in said collapsed positions, said drive means being connected to said lugs to move the lugs between said collapsed and expanded positions along the minor axis of the waveguide.

8. A tool as defined in claim 1 wherein the leading edges of said lugs, as they are moved toward said expanded positions, are tapered.

9. A method of forming a continuous external flare around the end of a corrugated elliptical waveguide having a connector member thereon, said elliptical waveguide having major and minor transverse axes, said method utilizing first and second flaring tools each having a pair of lugs sized to telescope at least partially into the end of said waveguide when the lugs of the pair are located near one another, said method comprising the steps of, fastening the first flaring tool to the connecting member with the lugs of such tool telescoped at least partially into the end of the waveguide, spreading the lugs of the first tool away from one another along the major axis of said waveguide to form an external flare around two spaced zones of the waveguide, detaching the first flaring tool from the connecting member, fastening the second flaring tool to the connecting member with the lugs of such tool at least partially telescoped into the end of the waveguide, and spreading the lugs of the second tool away from one another along the minor axis of said waveguide to form an external flare around the remaining two zones of the waveguide.

10. A method as defined in claim 9 wherein each of said pairs of lugs is centered with respect to the edges of the end of the waveguide along the respective major and minor axes along which the respective pairs of lugs are spread.

* * * * *